US005913262A

United States Patent [19]

Keppeler

[11] Patent Number: 5,913,262

[45] Date of Patent: Jun. 15, 1999

[54] BREECH FOR BARREL-TYPE FIREARMS

[75] Inventor: Dieter Keppeler, Fichtenberg, Germany

[73] Assignee: Sommer + Ockenfuss GmbH, Baiersbronn

[21] Appl. No.: 08/907,063

[22] Filed: Aug. 6, 1997

[51] Int. Cl.[6] ..... F41A 3/46

[52] U.S. Cl. ..... 89/187.02; 89/186

[58] Field of Search ..... 89/173, 174, 182, 89/184, 186, 187.01, 187.02, 190

[56] References Cited

U.S. PATENT DOCUMENTS

| | | | |
|---|---|---|---|
| 1,946,388 | 2/1934 | Chevallier | 89/182 |
| 2,267,501 | 12/1941 | Holek | 89/184 |
| 2,649,800 | 8/1953 | Peters | 42/16 |
| 3,044,203 | 7/1962 | Wilhelm et al. | 42/22 |
| 3,191,331 | 6/1965 | Hurley | 42/16 |
| 4,213,261 | 7/1980 | Claypool | 89/187.02 |
| 4,461,203 | 7/1984 | Jawdat | 89/154 |
| 4,655,118 | 4/1987 | Bruderer et al. | 89/185 |
| 4,909,129 | 3/1990 | Reynolds | 89/187.01 |

FOREIGN PATENT DOCUMENTS

| | | | |
|---|---|---|---|
| 607588 | 1/1935 | Germany | 89/186 |
| 538344 | 7/1941 | United Kingdom | 89/184 |

*Primary Examiner*—Stephen M. Johnson
*Attorney, Agent, or Firm*—Darby & Darby

[57] ABSTRACT

Breech for barrel-type firearms with a breech block head guided in a breech block support moveable from a loading position into a breech position, wherein the breech block head is provided with locking protrusions (5) corresponding with recesses (4) in the breech block support (3) and with control pins (9), and wherein the breech block head (6) can move formfittingly from the loading position into the breech position with the help of a control plate (7) supported for rectilinear movement and associated with the control pins (9) and provided with control ramps (8).

1 Claim, 1 Drawing Sheet

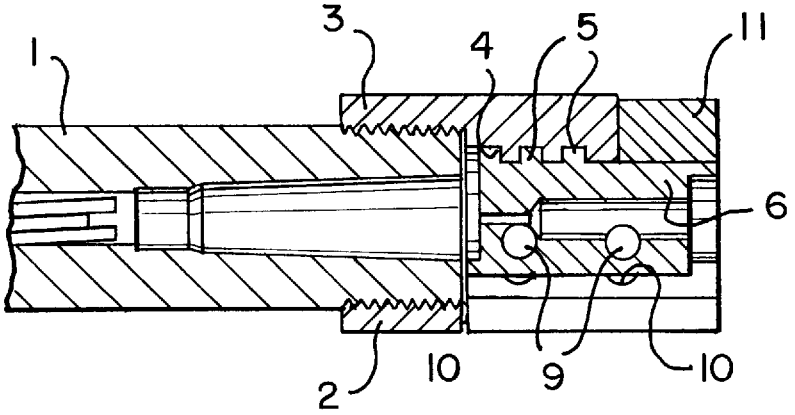
FIG. 1
FIG. 2a
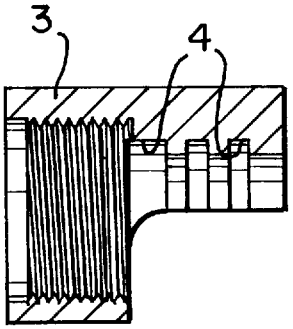
FIG. 2b
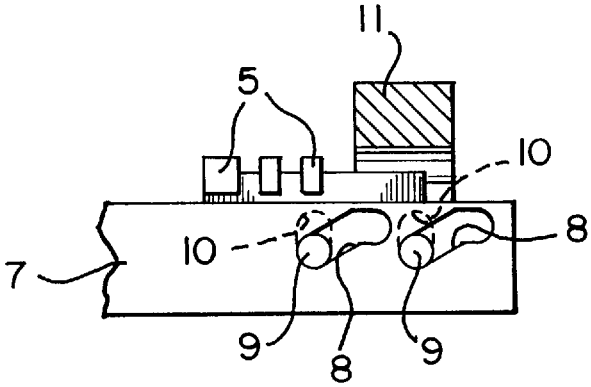
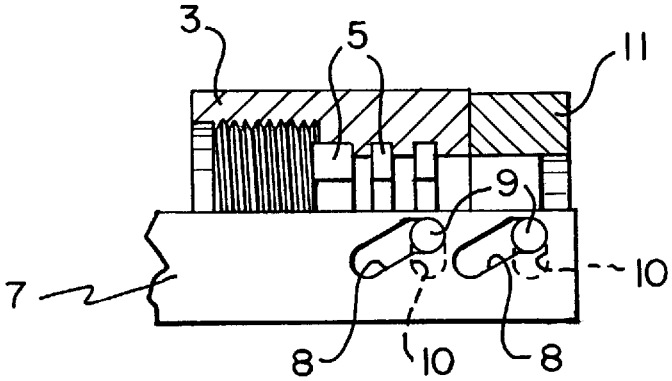
FIG. 3

BREECH FOR BARREL-TYPE FIREARMS

BACKGROUND OF THE INVENTION

The invention relates to a breech for barrel-type firearms with a breech block head guided in a breech block support and moveable from a loading position into a breech position.

This type of breech which allows the rearward end of the barrel to be loaded and sealingly closed after a barrel-type firearm has been loaded, is known in the art. Most common with small firearms are the so-called rotating protrusion breeches, wherein several locking protrusions are rotatably locked with recesses in the breech or in the breech sleeve by manually moving the chamber rod downward transversely to the weapon axis. Also known are so-called straight breeches which can be locked simply through a coaxial forward motion of the breech. However, these conventional straight breeches can without exception only be locked by employing rotating protrusions or elements which spread apart. Since the resulting force has to be reversed, a large forward momentum (closure momentum) and thus a longer breech unit is required.

SUMMARY OF THE INVENTION

It is the object of the invention to avoid using repeaters of this type by providing a novel breech of extremely short construction which can be linearly displaced by exercising only a small force, while at the same time also decreasing the length of the weapon.

The object is solved by the invention in that the breech block head is provided with locking protrusions corresponding with recesses in the breech block support and with control pins, wherein the breech block head can be moved formfittingly from the loading position into the breech position with the help of control plate which is supported for rectilinear movement, linked with the control pins and provided with control ramps.

Another feature of the invention provides for elongated holes associated with the control pins of the breech block head, with the elongated holes disposed in the breech block guide for formfittingly limiting the travel of the breech.

Additional features of the invention will become apparent from the dependent claims.

With the embodiment of the invention, the breech can be made extremely short while, at the same time, increasing the area of the locking surface represented by the locking protrusions which together ensure that the breech can be locked safely.

It is another advantage of the invention that the breech block head can be easily exchanged so that the same weapon can be used for firing cartridges with different diameters.

The invention will de described hereafter with reference to an exemplary embodiment which is schematically illustrated in the accompanying drawing. It is shown in:

BRIEF DESCRIPTION OF THE DRAWINGS

FIG. 1 cross sectional view through a portion of the breech of a barrel-type firearm in locked position, with details of the firearm omitted;

FIG. 2*a* an exploded view of the breech block support of FIG. 1;

FIG. 2*b* an exploded view of the breech block head and the breech block guide of the breech portion of FIG. 1, with a control plate operatively connected to the breech block head in the released position; and FIG. 3 side view of the breech in the locked position.

DETAILED DESCRIPTION OF A PREFERRED EMBODIMENT

With a barrel-type firearm in form of a handgun of which only a portion of the barrel 1 is shown, there is associated a lockable breech including a breech block support 3, a breech block head 6, a control plate 7 and a breech block guide 11.

The breech block support 3 is connected to the rearward portion of the barrel 1 via a barrel thread 2. In the breech block support 3, there are disposed recesses 4 corresponding with locking protrusions 5 of the breech block head 6. The breech block head 6 is formfittingly supported by control pins 9 for up and down movement in elongated holes 10 of the breech block guide 11 and is thereby transferable from the loading position into the breech position and vice versa. This is accomplished with the help of a control plate 7 supported for back and forth movement, i.e. for forward and backward movement relative to the barrel, with the control plate 7 having control ramps 8 for likewise formfittingly guiding the control pins 9 disposed on the breech block head 6.

When the control plate 7 moves forward, the breech block head 6 is formfittingly lifted by the control pins 9 sliding over the control ramps 8 by a distance corresponding to the respective guide members—represented by the ramps 8 in the control plate 7 and the elongated holes 10 of the breech block support 11—, whereas the release of the breech block head 6 takes place in the reverse order when the control plate 7 moves back.

The control plate 7 can be actuated mechanically or can be controlled through gas pressure.

The aforedescribed breech for barrel-type firearms which operates without relying on a rotation or a spreading motion of the breech block head, can be employed with firearms with long as well as with short barrels; moreover, this breech can also be used with heavy machine guns and artillery pieces.

LIST OF REFERENCE NUMERALS

1=barrel
2=barrel thread
3=breech block support
4=recesses
5=locking protrusions
6=breech block head
7=control plate
8=control ramp
9=control pins
10=elongated hole
11=breech block guide

We claim:

1. A breech block structure for a barrel-type firearm, comprising a breech block head guided in a breech block support moveable from a loading position into a breech block position;

the breech block head is provided with locking protrusions corresponding with recesses in the breech block support and with control pins, elongated holes being associated with the control pins, the elongated holes being disposed in a breech block guide for formfittingly limiting the travel of the breech block;

the breech block head is formfittingly moveable from the loading position into the breech block position by means of a of a control plate, supported for rectilinear movement associated with the control pins and with control ramps; and wherein the control plate is moveable in a straight path back and forth.

* * * * *

UNITED STATES PATENT AND TRADEMARK OFFICE

CERTIFICATE OF CORRECTION

PATENT NO. : 5,913,262
DATED : June 15, 1999
INVENTOR(S) : Dieter Keppeler

It is certified that error appears in the above-identified patent and that said Letters Patent is hereby corrected as shown below:

In the Assignee's address on the cover page of the patent:

Change "[73] Assignee: Sommer + Ockenfuss GmbH, Baiersbronn" to --[73] Assignee: Sommer + Ockenfuss GmbH, Baiersbronn, Germany--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*